US012252862B2

(12) United States Patent
Miller

(10) Patent No.: US 12,252,862 B2
(45) Date of Patent: Mar. 18, 2025

(54) COMPACTION WHEEL ASSEMBLY

(71) Applicant: Rockland, Inc., Bedford, PA (US)

(72) Inventor: Nathaniel Miller, Altoona, PA (US)

(73) Assignee: Rockland, Inc., Bedford, PA (US)

( * ) Notice: Subject to any disclaimer, the term of this patent is extended or adjusted under 35 U.S.C. 154(b) by 961 days.

(21) Appl. No.: 17/307,954

(22) Filed: May 4, 2021

(65) Prior Publication Data

US 2021/0340719 A1 Nov. 4, 2021

Related U.S. Application Data

(60) Provisional application No. 63/019,486, filed on May 4, 2020.

(51) Int. Cl.

| | |
|---|---|
| ***E02F 3/18*** | (2006.01) |
| ***E02F 3/96*** | (2006.01) |
| ***E02F 5/22*** | (2006.01) |

(52) U.S. Cl.

CPC ..... *E02F 3/188* (2013.01); *E02F 3/967* (2013.01); *E02F 5/223* (2013.01)

(58) Field of Classification Search

CPC ..... E02F 3/241; E02F 3/188; E02F 3/248
See application file for complete search history.

(56) References Cited

U.S. PATENT DOCUMENTS

| | | | | | |
|---|---|---|---|---|---|
| 1,717,618 | A * | 6/1929 | Muchnic | B61F 15/04 | 384/160 |
| 2,353,345 | A * | 7/1944 | Lindskog | A01B 45/026 | 172/21 |
| 2,386,946 | A * | 10/1945 | Greiner | E01C 19/26 | 74/400 |
| 4,381,874 | A * | 5/1983 | Strader | B60B 35/04 | 301/132 |
| 4,411,081 | A * | 10/1983 | King | E02F 5/223 | 404/121 |
| 4,723,870 | A * | 2/1988 | Martinez | E02D 3/026 | 301/128 |
| 4,950,102 | A * | 8/1990 | Zeitz | E01C 23/092 | 172/185 |
| 10,047,633 | B2 * | 8/2018 | Manchikanti | F16C 35/02 | |

* cited by examiner

*Primary Examiner* — Jessica H Lutz
(74) *Attorney, Agent, or Firm* — Paul D. Bangor, Jr., Esq.; Clark Hill PLC

(57) ABSTRACT

A compaction wheel assembly includes a shaft, a plurality of compaction wheels along the shaft, and at least one bushing assembly. The bushing assembly includes first and second split bushings axially spaced-apart to form a space therebetween, the upper and lower bushing housings removably secured together with the first and second split bushings therebetween to clamp the first and second split bushings about the shaft, and at least one first shim located between the bushing housings at a front side of the shaft and at least one second shim located between the bushing housings at a rear side of the shaft to space the upper and lower bushing housings and upper and lower halves of the first and second split bushings. At least one of the first and second shims includes a slot configured for feeding grease to the space between the first and second split bushings.

14 Claims, 7 Drawing Sheets

COMPACTION WHEEL ASSEMBLY

CROSS-REFERENCE TO RELATED APPLICATIONS

This Application claims the priority benefit of U.S. Provisional Patent Application No. 63/019,486 filed on May 4, 2020, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF INVENTION

The field of the invention generally relates to implements for earth-moving equipment, and, more particularly, to compaction wheel assemblies for excavators, backhoes, skid steers, and the like.

BACKGROUND OF THE INVENTION

Compaction wheels are frequently used in construction projects where soil must be filled either at grade (ground level) or below grade (below ground level) in order to avoid settling of the filled soil over time. For example, but not limited to, trenches are often cut into soil for the purpose of laying a line below grade. The line may be, for example but not limited to, a sewer pipe, a water pipe, a power line, a communications line, and the like. After laying of the line, the trench must be backfilled with soil. The backfilled soil must be compacted to avoid adverse effects of settling.

If the is trench is backfilled to grade level without compacting, the soil will later settle down to form a depression along the former trench. The depression can cause water to stand along the former trench. Vehicles traveling along or across the trench can be damaged by traversing the depression. Also, people and/or animals passing by may be injured if they do not see the depression.

Prior compaction wheel units or assemblies have been provided for compacting soil. Such prior art compaction wheel units are attached to the boom arms or the like of earth-moving equipment or machine such as, example but not limited to, for excavators, backhoes, skid steers, and the like. Typically, these compaction wheel units or assemblies have three compaction wheels on a single shaft or axle supported by a structure or frame secured to the earth-moving equipment. With the compaction wheels resting on the soil to be compacted, the compaction wheels rotate to compact the soil as the earth-moving machine moves. The compaction wheels typically are fixed in axially spaced-apart positions along the shaft or axle and rotate with the shaft or axle. Bearings typically hold the rotating shaft or axle and transfer axial and radial loads from the compaction wheels to the structure or frame supporting the shaft or axle.

While these prior compaction wheel units or assemblies have been effective at compacting soil, they are relatively expensive to maintain. Once the bearings become worn and need to replaced, the two outer compaction wheels must be removed from the shaft or axle in order to remove and replace the bearings. Often, the two outer compaction wheels are welded to the shaft or axle making it difficult and time consuming to remove and replace the outer compaction wheels. Alternative configurations for removably securing the outer compaction wheels to the shaft or axle such as, but not limited to, bolted taper locks and the like add significant cost to the compaction wheel unit or assembly. As a result, some owners of compaction wheel units or assemblies discard them once the bearings need replaced rather than replacing the bearings.

Accordingly, there is a need for improved compaction wheel units or assemblies.

SUMMARY OF THE INVENTION

Disclosed are compaction wheel assemblies that overcome at least one of the above-described problems associated with the prior art. Disclosed is a compaction wheel assembly comprising, in combination, a support structure, a laterally-extending shaft rotatable relative to the support structure, a plurality of compaction wheels spaced apart along the shaft and fixed to the shaft for rotation with the shaft, and at least one bushing assembly. The bushing assembly comprises first and second split bushings encircling the shaft and axially spaced-apart along the shaft to form a space therebetween, wherein each of the first and second split bushings has an upper half and a lower half, upper and lower bushing housings removably secured together with the first and second split bushings therebetween to clamp the first and second split bushings about the shaft, and at least one first shim located between the upper and lower bushing housings at a front side of the shaft and at least one second shim located between the upper and lower bushing housings at a rear side of the shaft to space the upper and lower bushing housings and the upper and lower halves of the first and second split bushings to provide a desired clearance between the shaft and the first and second split bushings. At least one of the first and second shims includes a slot configured for feeding grease to the space between the first and second split bushings. The upper and lower bushing housings are secured to the support structure.

Also disclosed is a compaction wheel assembly comprising, in combination. a support structure, a laterally-extending shaft rotatable relative to the support structure, first, second, and third compaction wheels spaced-apart along the shaft and fixed to the shaft for rotation with the shaft; a first bushing assembly between the first and second compaction wheels, and a second bushing assembly between the second and third compaction wheels. Each of the first and second bushing assemblies comprise first and second split bushings encircling the shaft and axially spaced-apart along the shaft to form a space therebetween, wherein each of the first and split bushings has an upper half and a lower half, upper and lower bushing housings removably secured together with the first and second split bushings therebetween to clamp the first and second split bushings about the shaft, and three first shims located between the upper and lower bushing housings at a front side of the shaft and three second shims located between the upper and lower bushing housings at a rear side of the shaft to space the upper and lower bushing housings and the upper and lower halves of the first and second split bushings to provide a desired clearance between the shaft and the first and second split bushings. The first shims include a slot configured for feeding grease to the space between the first and second split bushings. The upper and lower bushing housings are secured to the support structure.

Further disclosed is an earth moving machine comprising, in combination, an implement mounting structure, and a compaction wheel assembly. The compaction wheel assembly comprises a support structure secured to the implement mounting structure, a laterally-extending shaft rotatable relative to the support structure, a plurality of compaction wheels spaced apart along the shaft and fixed to the shaft for rotation with the shaft, and at least one bushing assembly. The at least one bushing assembly comprises first and second split bushings encircling the shaft and axially spaced-apart along the shaft to form a space therebetween, wherein each split bushing has an upper half and a lower half, upper and lower bushing housings removably secured together with the first and second split bushings therebetween to clamp the first and second split bushings about the shaft, and at least one first shim located between the upper and lower bushing housings at a front side of the shaft and at least one second shim located between the upper and lower bushing housings at a rear side of the shaft to space the upper and lower bushing housings and the upper and lower halves of the first and second split bushings to provide a desired clearance between the shaft and the first and second bushings. At least one of the first and second shims includes a slot configured for feeding grease to the space between the first and second split bushings. The upper and lower bushing housings are secured to the support structure.

From the foregoing disclosure and the following more detailed description of various preferred embodiments it will be apparent to those skilled in the art that the present invention provides a significant advance in the technology and art of compaction wheel assemblies. Particularly significant in this regard is the potential the invention affords for providing a relatively inexpensive compaction wheel assembly that can be maintained relatively quickly and inexpensively. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 1:
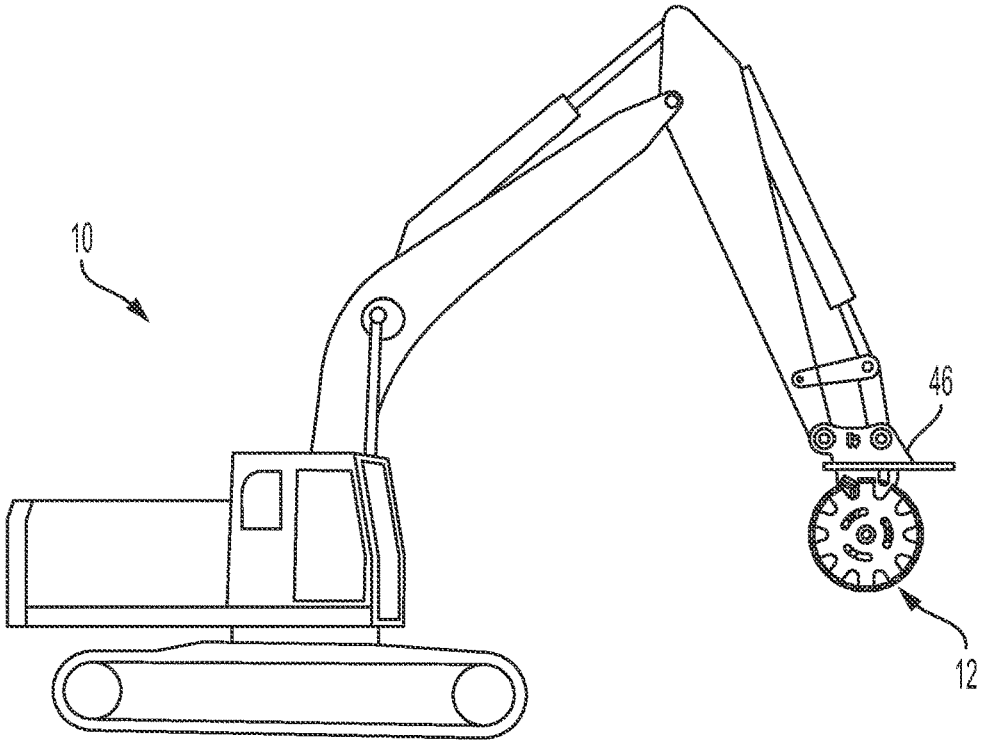
FIG. 1 is a right-side elevational view of an earth moving machine having a compaction wheel assembly according to the present invention secured thereto.
Figure 2:
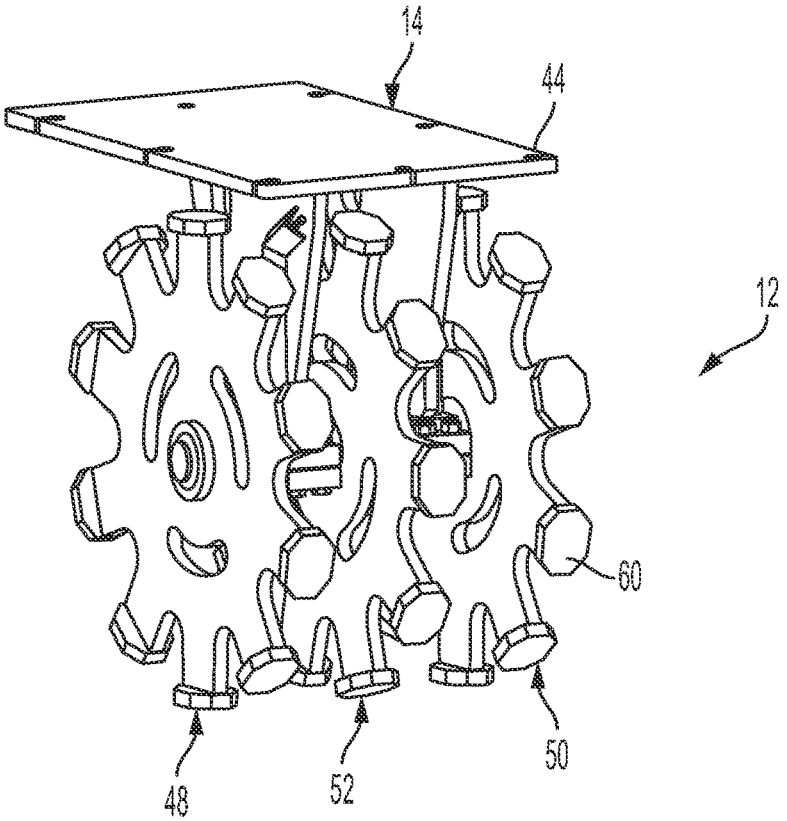
FIG. 2 is a perspective view of the compaction wheel assembly of FIG. 1.

It should be understood that the appended drawings are not necessarily to scale, presenting a somewhat simplified representation of various preferred features illustrative of the basic principles of the invention. The specific design features of the security devices as disclosed herein, including, for example, specific dimensions and shapes of the various components will be determined in part by the particular intended application and use environment. Certain features of the illustrated embodiments may be enlarged or distorted relative to others to facilitate visualization and clear understanding. In particular, thin features may be thickened, for example, for clarity or illustration. All references to direction and position, unless otherwise indicated, refer to the orientation of the components illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the compaction wheel assemblies disclosed herein. The following detailed discussion of various alternative and preferred embodiments will illustrate the general principles of the invention. Other embodiments suitable for other applications will be apparent to those skilled in the art given the benefit of this disclosure.

FIG. 1 illustrates an exemplary earth-moving equipment or machine 10 having a compaction wheel unit or assembly 12 according to the present invention secured thereto. The illustrated earth-moving equipment or machine 10 is an excavator but can alternatively be any other suitable type of earth-moving equipment or machine such as, for example but not limited to, a backhoe, a skid steer, and the like.

Figure 3:
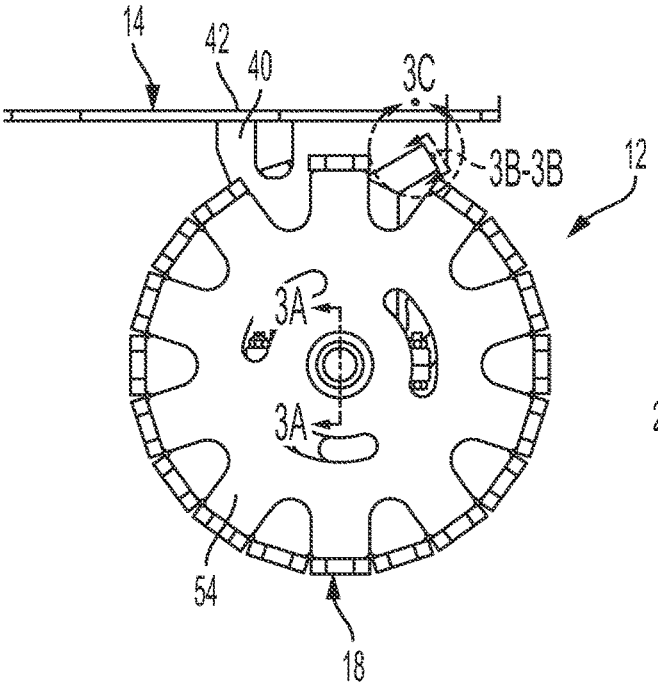
FIG. 3 is a right-side elevational view of the compaction wheel assembly of FIG. 2.
Figure 3A:
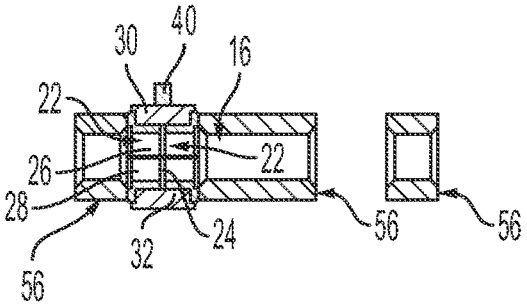
FIG. 3A is an enlarged cross-sectional view taken along line 3A-3A of FIG. 2, wherein the shaft and a second bushing assembly are removed for clarity.
Figure 3B:
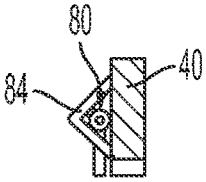
FIG. 3B is an enlarged cross-sectional view taken along line 3B-3B of FIG. 2.
Figure 3C:
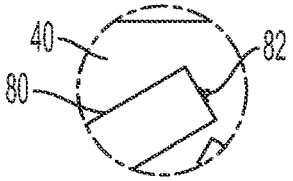
FIG. 3C is an enlarged fragmented view taken from line 3C of FIG. 2
Figure 4:
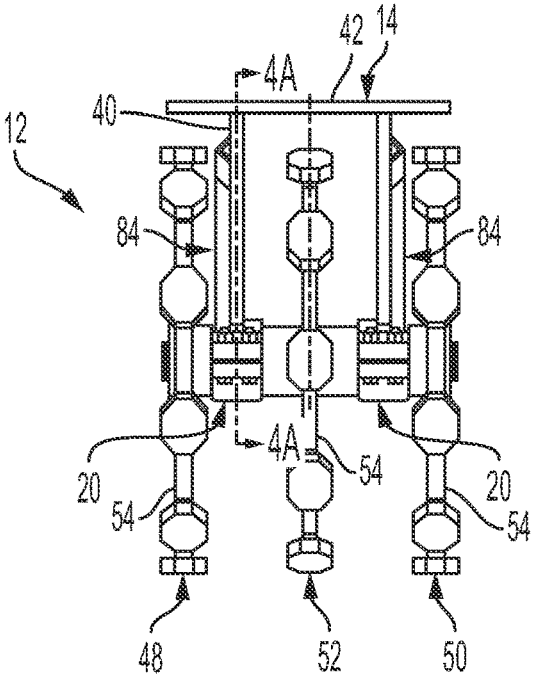
FIG. 4 is a front elevational view of the compaction wheel assembly of FIGS. 2 and 3.
Figure 4A:
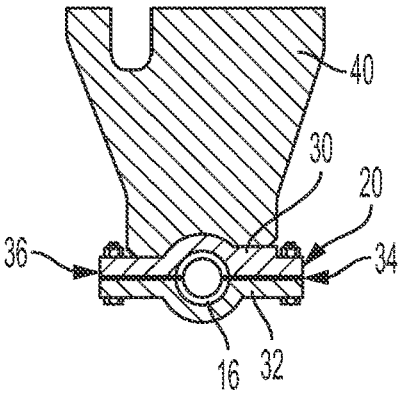
FIG. 4A is an enlarged cross-sectional view taken along line 4A-4A of FIG. 4.

FIGS. 2 to 7 show the illustrated compaction wheel unit or assembly 12 according to the present invention. The illustrated compaction wheel assembly 12 includes a support structure 14, a laterally-extending shaft 16 rotatable relative to the support structure 14, a plurality of compaction wheels 18 spaced apart along the shaft 16 and fixed to the shaft 16 for rotation with the shaft 16, and at least one bushing assembly 20 between the shaft 16 and the support structure 14 to support the rotating shaft 16. The illustrated compaction wheel assembly 12 includes two of the bushing assemblies 20 axially spaced-apart along the shaft 16 (best seen in FIG. 4). Each of the bushing assemblies 20 includes a pair of split bushings 22 encircling the shaft 16, facing each other, and axially spaced-apart along the shaft 16 to form a gap or space 24 therebetween in the axial direction (best seen in FIG. 3A). Each of the split bushings 22 has an upper bushing half 26, a lower bushing half 28, an upper bushing housing 30, and a lower bushing housing 32 (best seen in FIG. 4A). The upper and lower bushing housings 30, 32 are removably secured together with the upper and lower bushing halves 26, 28 therebetween to clamp the upper and lower bushing halves 26, 28 about the shaft 16. At least one first shim 34 is located between the upper and lower bushing housings 30, 32 at a front side of the shaft 16 and at least one second shim 36 is located between the upper and lower bushing housings 30, 32 at a rear side of the shaft 16 to space the upper and lower bushing housings 30, 32 and the upper and lower bushing halves 26, 28 to provide a desired clearance between the shaft 16 and the upper and lower bushing halves 26, 28. At least one of the first and second shims 30, 32 includes a slot 38 configured for feeding grease to the axial space 24 between the split bushings 22 (best seen in FIGS. 6 and 7). The upper and lower bushing housings 30, 32 are secured to the support structure 14 (best seen in FIGS. 4 and 4A).

The illustrated support structure 14 includes a pair of brackets 40 which upwardly extend from the upper bushing housings 30 on both lateral sides of the center compaction wheel 52 to a location above the compaction wheels 48, 50, 52. The illustrated brackets 14 are secured to the upper bushing housings 30 by welds but can alternatively be secured in any other suitable manner. A horizontally-extending header plate 42 extends over each of the compaction wheels 48, 50, 52 and is secured to the top of the brackets 40. The illustrated header plate 42 is secured to the brackets 40 by welds but can alternatively be secured in any other suitable manner. The illustrated header plate 42 is provided with bolt holes 44 configured to cooperate with an implement mounting structure 46 of the earth-moving machine 10 so that the header plate 42 can be removably bolted to the implement mounting structure 46. It is noted that the support structure 14 can alternatively have any other suitable configuration.

As best shown in FIGS. 8 to 10A, the illustrated rotatable shaft 16 is elongate with a circular-shaped cross section and laterally extends through three spaced-apart compaction wheels 48, 50, 52. First and second or outer compaction wheels 48, 50 are located near the ends of the shaft 16. A third or center compaction wheel 52 is centrally located on the shaft 16. The illustrated compaction wheels 48, 50, 52 are secured to the shaft 16 by welds so that the compaction wheels 48, 50, 52 and the shaft 16 rotate together in unison but can alternatively be secured in any other suitable manner. The illustrated compaction wheels 48, 50 52 each have a wheel rim 54 with a wheel boss 56 secured to at center of the wheel rim 54. The illustrated wheel boss 56 secured to the wheel rim 54 by welds so that the wheel rims 54 and the wheel bosses 56 rotate together in unison but can alternatively be secured in any other suitable manner. The wheel bosses 56 each have an opening 58 extending therethrough for closely receiving the shaft 16. The rim bosses 56 have lengths which provide suitable spaces therebetween to cooperate with the bushing assemblies 20 as described in more detail below. The illustrated wheel boss 56 of the center compaction wheel 52 has a length greater than the wheel bosses 56 of the outer compaction wheels 48, 50 so that the bushing assemblies 20 are generally equally space between the center of the shaft 16 and the ends of the shaft 16. The illustrated compaction wheels 48, 50, 52 each have a plurality spaced-apart tamper feet 60 secured to the outer periphery the wheel rim 54 with equal spacing. The illustrated tamper feet 60 are secured to the wheel rims 54 by welds so that the wheel rims 43 and the tamper feet 60 rotate together in unison but can alternatively be secured in any other suitable manner. The tamper feet 60 are sized and shaped to engage and compact the ground as the compaction wheels 48, 50, 52 roll along the ground. It is noted that the shaft 16 and the compaction wheels 48, 50, 52 can alternatively have any other suitable configuration.

The illustrated compaction wheel assembly 12 includes two of the bushing assemblies 20. The first bushing assembly 20 is located at the shaft between the first outer compaction wheel 48 and the center compaction wheel 52 and the second bushing assembly 20 is located between the second outer compaction wheel 50 and the center compaction wheel 52. It is noted that a fewer or greater number of compaction wheels, 48, 50, 52 can alternatively be utilized. It is also noted that a fewer or greater number of bushing assemblies 20 can be utilized depending on the number of compaction wheels 48, 50, 52 utilized.

Figure 11:
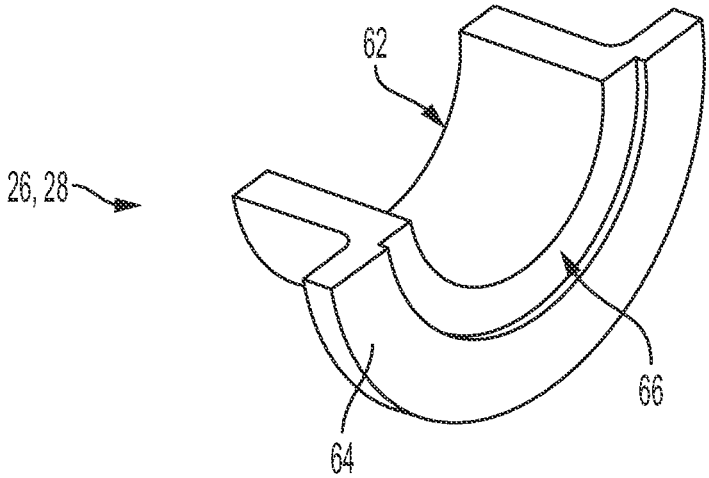
FIG. 11 is an enlarged perspective view of half of a split bushing of the compaction wheel assembly of FIGS. 2 to 4.
Figure 12:
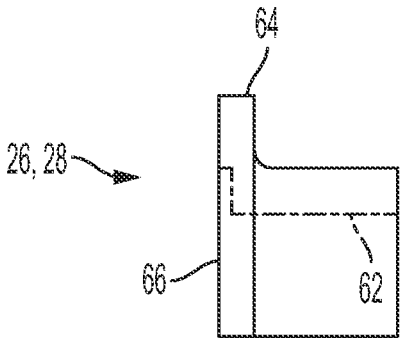
FIG. 12 is a transverse view of the split bushing of FIG. 11.
Figure 13:
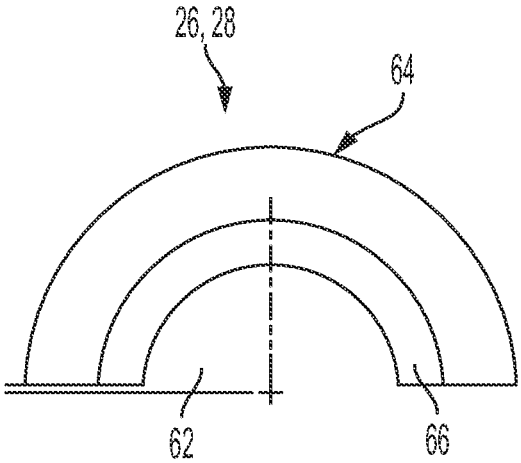
FIG. 13 an axial view of the split bushing of FIGS. 11 and 12.

The illustrated bushing assemblies 20 each include the first and second side-by-side split bushings 22 encircling the shaft. 16 Each of the first and second split bushings 22 has identical upper and a lower halves 26, 28 (best shown in FIGS. 11 to 13). Each of the split bushings 22 have a central opening 62 sized and shaped to closely receive the shaft 16 and an outer flange 64 that engages the adjacent wheel bosses 56 of the compaction wheels 48, 50, 52 which allows the split bushings 22 to take thrust loads and keeps the first and second split bushings 22 axially separated or spaced-apart along the shaft 16 to form the axial space or grease groove 24 therebetween. The illustrated bushing halves 26, 38 also have a central inset or cavity 66 on the outer side of the flange 64 that provides clearance for the weld securing the compaction wheel boss 56 to the shaft 16 and also holds grease. It is noted that the split bushings halves 26, 28 can alternatively have any other suitable configuration. The illustrated split bushing halves 26, 28 comprise Dura bar which is a ductile cast iron that contains about 10% graphite and has a strength and ductility similar to steel. It is noted that the split bushing halves 26, 28 can alternatively comprise any other suitable material or materials.

Figure 14:
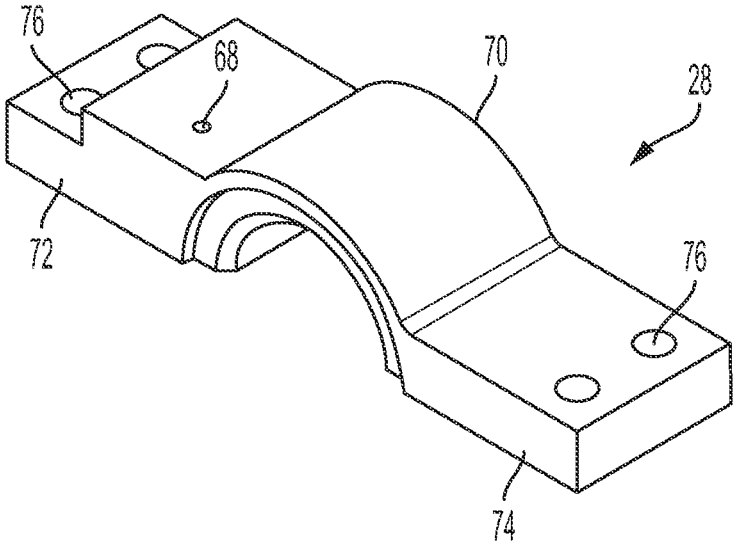
FIG. 14 is a perspective view an upper bushing housing of the compaction wheel assembly of FIGS. 2 to 4.
Figure 15:
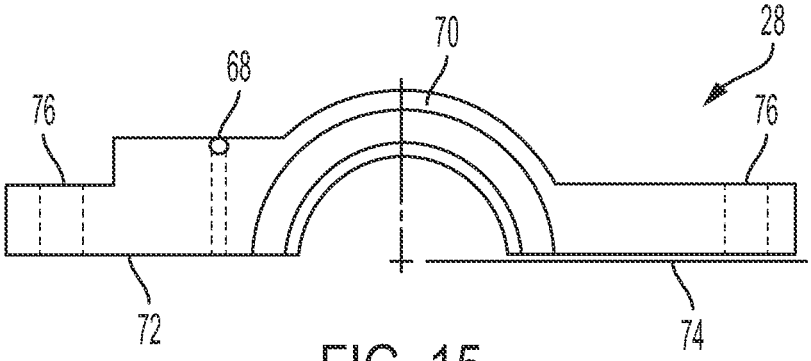
FIG. 15 is a transverse view of the upper bushing housing of FIG. 14.
Figure 16:
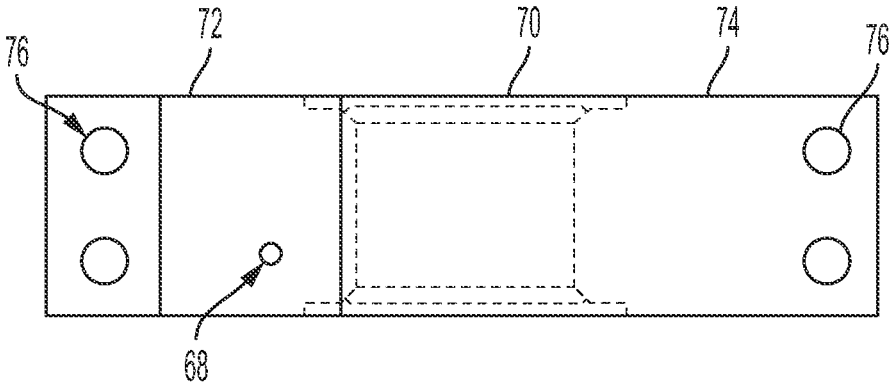
FIG. 16 is top an view of the upper bushing housing of FIGS. 14 and 15.

The upper and lower bushing housings 30, 32 are removably secured together with the first and second split bushings 22 therebetween to clamp the first and second split bushings 22 about the shaft 16. FIGS. 14 to 16 show the illustrated upper bushing housing 30 for the first bushing assembly 20. It is noted that the illustrated lower bushing housing 32 is substantially the same as the upper bushing housing 30 except that it does not have a grease hole 68 as described in more detail below. It is also noted that the upper bushing housing 30 for the second bushing assembly 20 is substantially the same as the upper bushing housing 30 for the first bushing assembly 20 except that the grease hole 68 is located near the opposite side so that it is near the bracket 40 of the support structure 14 as described in more detail below. The illustrated upper and lower bushing housings 30, 32 each have a central portion 70 sized and shaped to engage the outer surface of the first and second split bushings 22 and forward and rearward flanges 72, 74 extending from the central portion 70. The illustrated flanges 72, 74 each have a pair of spaced apart fastener openings 76 so that hexbolts and locknuts can be utilized to secure the upper and lower housings 30, 32 together with the first and second split bushings 22 therebetween to clamp the first and second split bushings 22 onto the shaft 16. Clamped in this manner, the shaft 16, along with the compaction wheels 48, 50, 52 secured thereto, can rotate within the split bushings 22.

Figure 5:
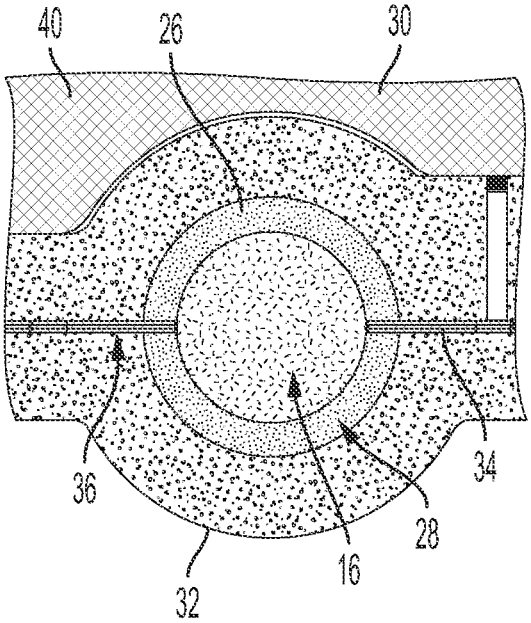
FIG. 5 is an enlarged fragmented view a e shaft in FIG. 4A.
Figure 6:
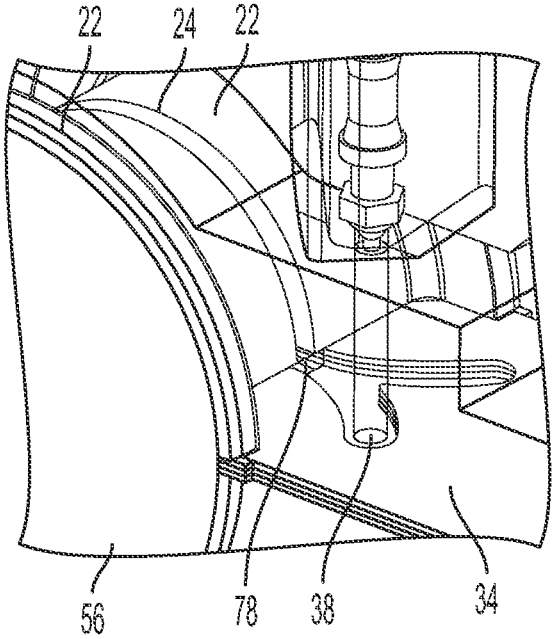
FIG. 6 is a fragmented perspective view of the bushing assembly of FIG. 4A, wherein components are removed for clarity.
Figure 7:
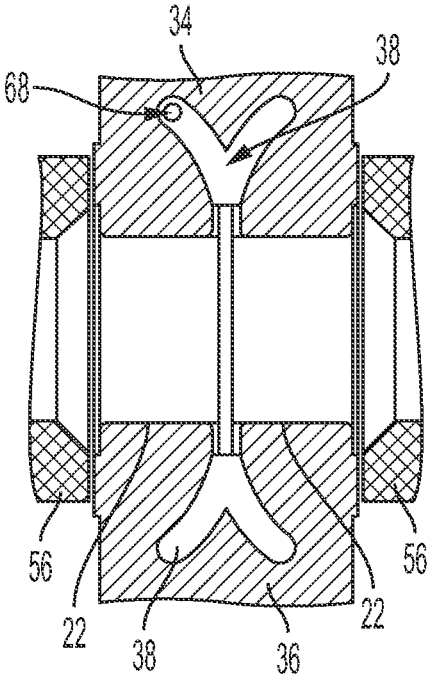
FIG. 7 is an enlarged and fragmented top plan view of the bushing assembly of FIG. 4A, wherein components are removed for clarity.
Figure 8:
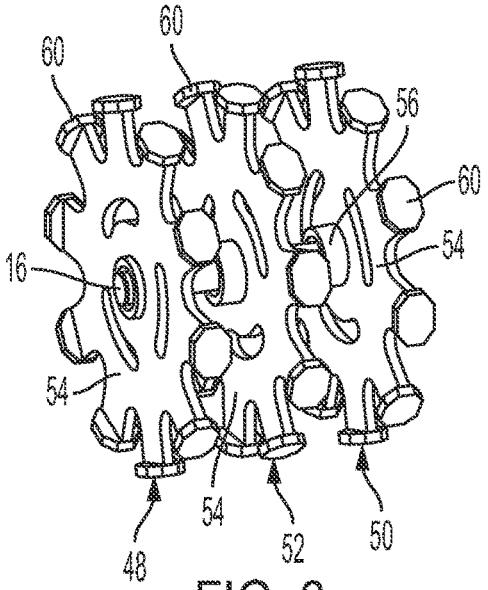
FIG. 8 is a perspective view of the shaft and compaction wheels of the compaction wheel assembly of FIGS. 2 to 4.
Figure 9:
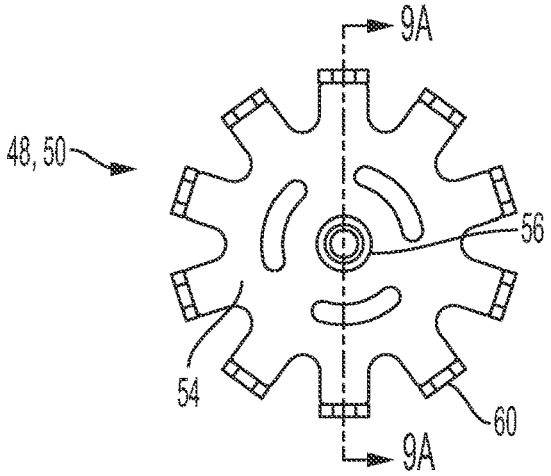
FIG. 9 is a side view of an outer compaction wheel of FIG. 8.
Figure 9A:
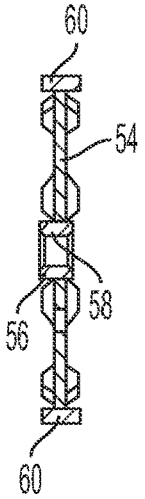
FIG. 9A is a cross-sectional view taken along line 9A-9A of FIG. 9.
Figure 10:
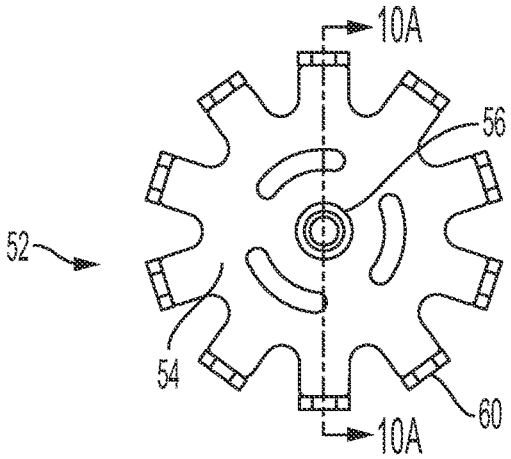
FIG. 10 is a side view of a central compaction wheel of FIG. 8.
Figure 10A:
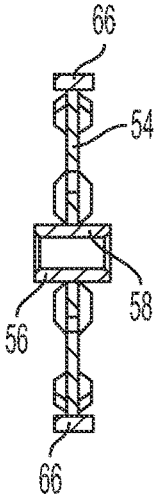
FIG. 10A is a cross-sectional view taken along line 10A-10A of FIG. 10.

The least one first shim 34 is located between the forward flanges 72 of the upper and lower bushing housings 30, 32 at a front side of the shaft 16 and the at least one second shim 36 is located between the rearward flanges 74 of the upper and lower bushing housings at a rear side of the shaft to space the upper and lower bushing housings and the upper and lowe30, 32 r halves of the first and second split bushings 22 to provide a desired clearance between the shaft 16 and the first and second split bushings 22 (best shown in FIGS. 5 to 7). The thickness of the shims 34, 36 is sized to provide the desired clearance between the split bushings 22 and the shaft 16. Because the first and second shims 34 36 extend partially between the split bushing halves 26, 28, the shims 34, 36 also create a space or gap 78 in the vertical direction between the split busing halves 26, 28 of both of the first and second split bushings 22. The illustrated embodiment has a stack of three identical first shims 34 and a stack of three identical second shims 36. It is noted that any other suitable quantity and/or configuration of the shims 34, 36 can be utilized.

At least one of the first and second shims 34, 36 includes the slot or cut out 38 configured for feeding grease to the axial space or grease gap 24 located between the first and second split bushings 22. The illustrated first and second shims 34, 36 are all identical to reduce the number of unique parts and thus reduce costs. However, it is noted that only the slots 38 in the first shims 34 are utilized in the illustrated embodiment because only the forward flanges 72 of the upper bushing housings 30 are provided with grease holes openings 68. The illustrated slots 38 are generally Y-shaped extend outwardly from an inner edge of the shim 34 located at the axial space 24 between the first and second split bushings 22 and then splitting into two arms in generally opposite directions but stopping short of the outer edge of the shim 34. The two arms of the slot 38 are sized and shaped to cooperate with the grease holes 68 in the upper bushing housing 30. It is noted that in the illustrated embodiment, only one of the two arms of the slot 38 is utilized depending on whether it is located within the first or second bushing assembly 20 which have the grease holes 68 on opposite sides. It is noted that the slots 38 can alternatively have any other suitable configuration.

Figure 17:
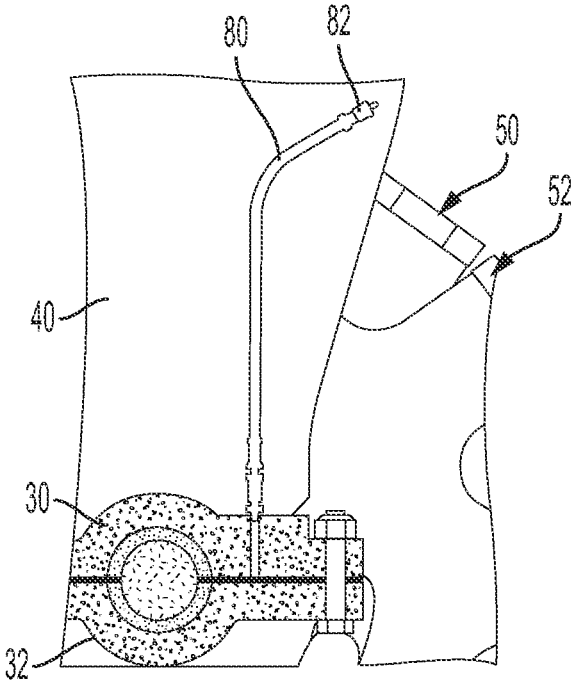
FIG. 17 is diagrammatic view of a grease line of the compaction wheel assembly of FIGS. 2 to 4.
Figure 18:
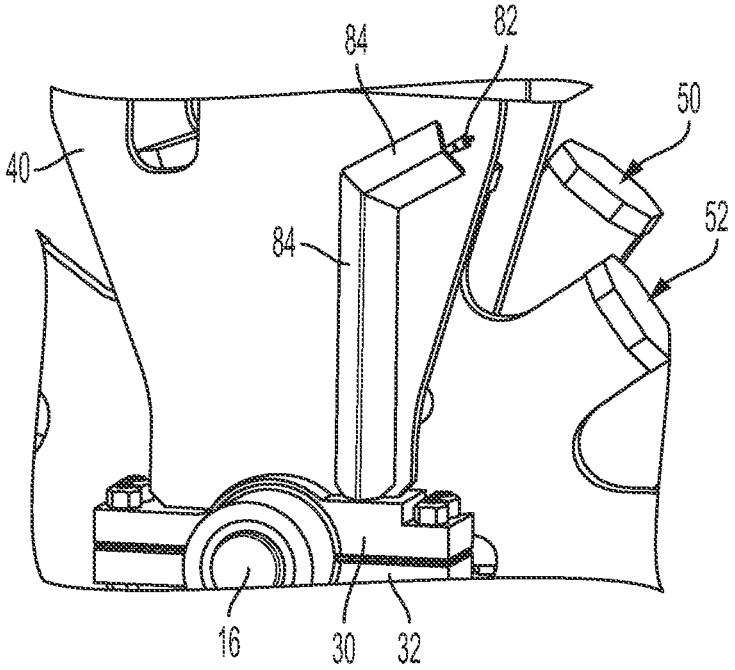
FIG. 18 is diagrammatic vie a of the grease line of FIG. 17 with protectors or covers secured over the grease line.

As best shown in FIGS. 17 and 18, a grease line or hose 80 is secured to the upper or outer end of the grease bole or opening 68 in the upper bushing housing 30 and extends up along the outer side of the carrier plate or bracket 40 and then angles forward to a location near the forward edge of the carrier plate or bracket 40. An upper end of the grease line or hose 80 is provided with a grease fitting 82. Grease protectors or covers 84 are provided over the grease line or hose 80 and secured to the carrier plate or bracket 40 to protect the grease line or hose 80.

To provide grease to the first and second split bushings 22, grease is injected through the fitting 82 at the top of the grease line or hose 60. The grease passes downward through the grease line or hose 80 and out the lower end of the grease line or hose 90 and into the top or inlet of the grease hole 68 in the upper bushing hosing 30. The grease then passes down through the grease hole 68 and out the bottom or outlet of the grease hole 68 and into the outer end of the slot 38 in the first shims 34. The grease then passes through the slot 38 in the first shims 34 and into the gap 24 between the first and second split bushings 22. Once within the gap 24, the grease spreads with the gap 24 between the first and second split bushings 22, within the gap 78 between the split bushings halves 26, 28, and within the cavity 66 between the split busing halves 26, 28 and the shaft 16 and the compaction wheel bosses 56. It is noted that the grease path can alternatively have any other suitable configuration.

To replace the split bushings 22 once they are worn, first the bolts are removed from the upper and lower bushing housings 30, 32 so that the lower bushing housings 32 can be removed. The shaft 16, with the compaction wheels 48, 50, 52 still secured thereto, is then dropped from the upper busing housings 30 The split bushings 22 are then removed and replaced with new split bushings 22. The components are then put back together in reverse order of the above description. Finally, grease is injected into the split bushings 22 as described above. It is noted that the outer compaction wheels 48, 50 do not need to be removed from the shaft 16 in order to replace the worn split bushings 22. Alternatively, when there is more than one of the shims 34, 36, a shim 34, 36 can be removed to tighten the worn split bushings 22 on the shaft 16 instead replacing the worn split bushings. 22

Any of the features or attributes of the above-described embodiments and variations can be used in combination with any of the other features and attributes of the above-described embodiments and variations as desired.

From the foregoing disclosure it will be apparent that the illustrated compaction wheel assembly provides lower cost of manufacturing and improved and lower cost maintenance.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A compaction wheel assembly comprising, in combination:

a support structure;

a laterally-extending shaft rotatable relative to the support structure;

a plurality of compaction wheels spaced apart along the shaft and fixed to the shaft for rotation with the shaft; and at least one bushing assembly comprising:

first and second split bushings encircling the shaft and axially spaced-apart along the shaft to form a space therebetween, wherein each of the first and second split bushings has an upper half and a lower half;

upper and lower bushing housings removably secured together with the first and second split bushings therebetween to clamp the first and second split bushings about the shaft; and at least one first shim located between the upper and lower bushing housings at a front side of the shaft and at least one second shim located between the upper and lower bushing housings at a rear side of the shaft to space the upper and lower hushing housings and the upper and lower halves of the first and second split bushings to provide a desired clearance between the shaft and the first and second split bushings;

wherein at least one of the first and second shims includes a slot configured for feeding grease to the space between the first and second split bushings; and wherein the upper and lower bustling housings are secured to the support structure;

wherein the upper half and the lower half of each of the first and second split bushings each has a flange to provide thrust support; and wherein an outer side of the flange has a cavity configured hold grease between the flange and an adjacent one of the plurality of compaction wheels.

2. The compaction wheel assembly according to claim 1, wherein the at least one first shim and the at least, one second shim extends partially between the upper half and the lower half of each of the first and second split bushings.

3. The compaction wheel assembly according to claim 1, wherein there is a grease hole in at least one of the upper and lower busing housings which is in communication with the slot to feed grease to the slot.

4. The compaction wheel assembly according to claim 3, further comprising a grease line secured to an outer end of the grease hole to feed grease to the grease hole.

5. The compaction wheel assembly according to claim 1, wherein the slot is Y-shaped.

6. The compaction wheel assembly according to claim 1, wherein each of the plurality of compaction wheels are welded to the shaft.

7. The compaction wheel assembly according to claim 1, wherein the upper bushing housing is welded to the support structure.

8. The compaction wheel assembly according to claim 7, wherein the upper and lower bushing housings are secured together by bolts.

9. A compaction wheel assembly comprising, in combination:

a support structure;

a laterally-extending shaft rotatable relative to the support structure;

first, second and third compaction wheels spaced apart along the shaft and fixed to the shaft for rotation with the shaft; and a first bushing assembly between the first and second compaction wheels and a second bushing assembly between the second and third compaction wheels, wherein each of the first and second bushing assemblies comprises:

first and second split bushings encircling the shaft and axially spaced-apart along the shaft to form a space therebetween, wherein each of the first and second split bushings has an upper half and a lower half;

upper and lower bushing housings removably secured together with the first and second split bushings therebetween to clamp the first and second split bushings about the shaft; and three first shims located between the upper and lower bushing housings at a front side of the shaft and three second shims located between the upper and lower bushing housings at a rear side of the shaft to space the upper and lower bushing housings and the upper and lower halves of the first and second split bushings to provide a desired clearance between the shaft and the first and second split bushings;

wherein each of the first shims includes a slot configured for feeding grease to the space between the first and second split bushings;

wherein the upper and lower bushing housings are secured to the support structure;

wherein the upper half and the lower half of each of the first and second split bushings each has a flange to provide thrust support; and wherein an outer side of the flange has a cavity configured hold grease between the flange and an adjacent one of the plurality of compaction wheels.

10. The compaction wheel assembly according to claim 9, wherein the first shims and the second shims extend partially between the upper half and the lower half of each of the first and second split bushings.

11. The compaction wheel assembly according to claim 9, wherein there is a grease hole in at least one of the upper and lower busing housings which is in communication with the slots in the first shims to feed grease to the slots.

12. An earth moving machine comprising, in combination:

an implement mounting structure; and a compaction wheel assembly comprising:

a support structure secured to the implement mounting structure;

a laterally-extending shaft rotatable relative to the support structure;

a plurality of compaction wheels spaced apart along the shaft and fixed to the shaft for rotation with the shaft; and at least one bushing assembly comprising:

first and second split bushings encircling the shaft and axially spaced-apart along the shaft to form a space therebetween, wherein each of the first and second split bushings has an upper half and a lower half;

upper and lower bushing housings removably secured together with the first and second split bushings therebetween to clamp the first and second bushings about the shaft; and at least one first shim located between the upper and lower bushing housings at a front side of the shaft and at least one second shim located between the upper and lower bushing housings at a rear side of the shaft to space the upper and lower bushing housings and the upper and lower halves of the first and second split bushings to provide a desired clearance between the shaft and the first and second bushings;

wherein at least one of the first and second shims includes a slot configured for feeding grease to the space between the first and second split bushings;

wherein the upper and lower bushing housings are secured to the support structure;

wherein the upper haft and the lower half of each of the first and second split bushings each has a flange to provide thrust support; and wherein an outer side of the flange has a cavity configured hold grease between the flange and an adjacent one of the plurality of compaction wheels.

13. The compaction wheel assembly according to claim 12, wherein the at least one first shim and the at least one second shim extends partially between the upper half and the lower half of each of the first and second split bushings.

14. The compaction wheel assembly according to claim 12, wherein there is a grease hole in at least one of the upper and lower busing housings which is in communication with the slot to feed grease to the slot.

* * * * *